US007936334B2

(12) United States Patent
Choi

(10) Patent No.: US 7,936,334 B2
(45) Date of Patent: May 3, 2011

(54) DISPLAY APPARATUS

(75) Inventor: Byeong-bae Choi, Hwanseong-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 1296 days.

(21) Appl. No.: 11/218,549

(22) Filed: Sep. 6, 2005

(65) Prior Publication Data

US 2006/0055988 A1 Mar. 16, 2006

(30) Foreign Application Priority Data

Sep. 13, 2004 (KR) ..... 10-2004-0073187

(51) Int. Cl.
*G09G 3/36* (2006.01)

(52) U.S. Cl. ..... 345/101; 345/204

(58) Field of Classification Search ..... 345/60–72, 345/690–699, 87–104, 204–215; 341/126–172; 315/169.4; 348/571–574
See application file for complete search history.

(56) References Cited

U.S. PATENT DOCUMENTS

| | | | | |
|---|---|---|---|---|
| 4,490,713 | A * | 12/1984 | Mrozowski et al. | 341/163 |
| 4,729,026 | A * | 3/1988 | Suzuki et al. | 348/572 |
| 4,860,103 | A * | 8/1989 | Azam et al. | 348/572 |
| 4,908,621 | A * | 3/1990 | Polonio et al. | 341/120 |
| 5,029,982 | A * | 7/1991 | Nash | 349/72 |
| 6,057,891 | A * | 5/2000 | Guerin et al. | 348/572 |
| 6,496,177 | B1 * | 12/2002 | Burton | 345/101 |
| 2004/0227651 | A1 * | 11/2004 | Furuichi | 341/120 |
| 2007/0001993 | A1 * | 1/2007 | Koizumi et al. | 345/101 |

FOREIGN PATENT DOCUMENTS

| | | |
|---|---|---|
| JP | 11-45114 | 2/1999 |
| JP | 2003-142955 | 5/2003 |
| KR | 1020020079244 | * 12/2002 |
| KR | 2003-58763 | 7/2003 |
| KR | 10-418703 | 2/2004 |
| KR | 2004-11662 | 2/2004 |
| KR | 2004-51333 | 6/2004 |

OTHER PUBLICATIONS

Korean Office Action dated Apr. 25, 2006 issued in KR 2006-73187.

* cited by examiner

*Primary Examiner* — Alexander Eisen
*Assistant Examiner* — Patrick Marinelli
(74) *Attorney, Agent, or Firm* — Stanzione & Kim, LLP

(57) ABSTRACT

A displaying apparatus includes a signal input unit through which an analog image signal is input, an A/D converter to convert the analog image signal input through the signal input unit into a digital image signal according to a preset offset value thereof, a monitoring unit to sense a generation of an abnormal operating condition of the A/D converter, and a controlling unit to store information on a desired reference digital image signal corresponding to the preset offset value, to compare the digital image signal output from the A/D converter with the desired reference digital image signal information when the generation of an abnormal operating condition of the A/D converter is sensed by the monitoring unit, and to the preset offset value of the A/D converter when the digital image signal output from the A/D converter is different from the desired reference digital image signal, so that the digital image signal output from the A/D converter matches the desired reference digital image signal. Accordingly, a displaying apparatus is capable maintaining regularity of colors in image pictures that are displayed, regardless of any change in operational environment of an A/D converter, and in particular, a change in temperature of an image signal processing unit or a change in an analog image signal input thereto.

27 Claims, 4 Drawing Sheets

DISPLAY APPARATUS

CROSS-REFERENCE TO RELATED APPLICATIONS

This application claims priority from Korean Patent Application No. 2004-73187, filed on Sep. 13, 2004 in the Korean Intellectual Property Office, the disclosure of which is incorporated herein in its entirety by reference.

BACKGROUND OF THE INVENTION

1. Field of the Invention

The present general inventive concept relates to a displaying apparatus, and more particularly, to a displaying apparatus capable of maintaining color regularity in image pictures that are displayed, regardless of any change in operational environment of an A/D converter, and in particular, a change in temperature of an image signal processing unit or a change in an analog image signal input thereto.

2. Description of the Related Art

A conventional displaying apparatus comprises a signal input unit that receives an image signal input from outside the displaying apparatus, an image signal processing unit that processes the image signal input through the signal input unit, and a displaying unit that displays thereon an image picture based on the image signal output from the image signal processing unit. In other words, the image signal input through the signal input unit is processed by the image signal processing unit in order to display the image picture on the displaying unit.

In this conventional displaying apparatus, the image signal processing unit comprises an A/D converter that converts an analog image signal input through the signal input unit into a digital image signal according to a preset offset value of the A/D converter, and a scaler IC that processes the digital image signal output from the A/D converter to display the processed digital image signal on the displaying unit.

The A/D converter is designed to convert the analog image signal input thereto into a reference digital image signal corresponding to the preset offset value having desired color data (i.e., RGB data). However, a temperature of the image signal processing unit tends to change according to a driving condition of the displaying apparatus. This change in the temperature influences performance of the A/D converter. As a result, the A/D converter converts the input analog image signal into a digital image signal, which is irregular (i.e., does not have the desired color data) because of the change in the temperature of the image signal processing unit. In addition, when the analog image signal input to the A/D converter changes because of an external cause, the A/D converter processes the analog image signal input thereto into a digital image signal according to the preset offset value, without considering the change in the input analog image signal, thereby, making it difficult to output the reference digital image signal having the desired RGB data.

In the conventional displaying apparatus, the RGB data of the digital image signal output by the A/D converter may be irregular because of the change in the temperature of the image signal processing unit or the change in the analog image signal input to the A/D converter. As a result, it is fairly common to have image pictures with irregular color (i.e., RGB data) displayed on the displaying unit.

SUMMARY OF THE INVENTION

Accordingly, the present general inventive concept provides a displaying apparatus capable of maintaining color regularity in image pictures that are displayed, regardless of any change in operational environment of an A/D converter, and in particular, a change in temperature of an image signal processing unit or a change in an analog image signal input thereto.

Additional aspects and advantages of the present general inventive concept will be set forth in part in the description which follows and, in part, will be obvious from the description, or may be learned by practice of the general inventive concept.

The foregoing and/or other aspects and advantages of the present general inventive concept are achieved by providing a displaying apparatus including a displaying unit, comprising a signal input unit through which an analog image signal is input, an A/D converter to convert the analog image signal input through the signal input unit into a digital image signal according to a preset offset value thereof, a monitoring unit to sense a generation of an abnormal operating condition of the A/D converter, and a controlling unit to store information on a desired reference digital image signal corresponding to the preset offset value, to compare the digital image signal output from the A/D converter with the desired reference digital image signal information when the generation of an abnormal operating condition of the A/D converter is sensed by the monitoring unit, and to calibrate the preset offset value of the A/D converter when the digital image signal output from the A/D converter is different from the desired reference digital image signal, so that the output digital image signal matches the desired reference digital image signal.

The displaying apparatus may further comprise a scaler IC including the A/D converter to process the digital image signal output from the A/D converter and to display the processed digital image signal on the displaying unit.

The monitoring unit may comprise a temperature sensing unit to sense a temperature of the scaler IC. The controlling unit can compare the digital image signal output from the A/D converter with the desired reference digital image signal information when a change in the temperature of the scaler IC is sensed by the temperature sensing unit, and calibrate the preset offset value of the A/D converter when the digital image signal output from the A/D converter is different from the desired reference digital image signal information, so that the output digital image signal matches the desired reference digital image signal.

The monitoring unit may comprise an input signal monitoring unit to monitor the analog image signal input to the A/D converter. The controlling unit can store one or more offset values of the A/D converter corresponding to one or more reference digital image signals obtainable according to (1) a state of the analog image signal input through the signal input unit and (2) the temperature of the scaler IC, and then compare the digital image signal output from the A/D converter with the desired reference digital image signal information corresponding to the preset offset value when the change in the temperature of the scaler IC or a change in the input analog image signal is sensed by the temperature sensing unit and the input signal monitoring unit. The controlling unit can then calibrate the preset offset value of the A/D converter when the output digital image signal is different from the desired reference digital image signal, so that the digital image signal output from the A/D converter matches the desired reference digital image signal.

The scaler IC may include the controlling unit.

The controlling unit can calibrate the preset offset value of the A/D converter during a blanking period in which an image picture displayed on the displaying unit changes, when the digital image signal output from the A/D converter is different from the desired reference image signal information, so that the output digital image signal matches the desired reference digital image signal.

The monitoring unit may further comprise a signal level monitoring unit to monitor a level of the digital image signal output from the A/D converter, and a scaler IC comprising the signal level monitoring unit to process the digital image signal output from the A/D converter to display the processed digital image signal on the displaying unit and to output to the controlling unit a signal to inform the controlling unit of a generation of an abnormal operating condition when the signal level of the digital image signal output from the A/D converter changes. The controlling unit can store information on the desired reference digital image signal corresponding to the preset offset value and calibrate the preset offset value of the A/D converter and the digital image signal output from the A/D converter is different from the desired reference digital image signal information, when the signal to inform the controlling unit of the generation of an abnormal operating condition is received from the scaler IC, so that the digital image signal output from the A/D converter matches the desired reference digital image signal.

The monitoring unit may further comprise an input signal monitoring unit to monitor an analog image signal input to the A/D converter. The controlling unit can store one or more offset values of the A/D converter corresponding to one or more reference digital image signals obtainable according to one or more analog image signals input through the signal input unit and compare the digital image signal output from the A/D converter with the desired reference digital image signal information corresponding to the preset offset value, when the signal to inform the controlling unit of the generation of an abnormal operating condition is received from the scaler IC or a change in the input analog image signal is sensed by the input signal monitoring unit. The controlling unit can then calibrate the preset offset value of the A/D converter when the digital image signal output from the A/D converter is different from the desired reference digital image signal, so that the output digital image signal matches the desired reference digital image signal.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
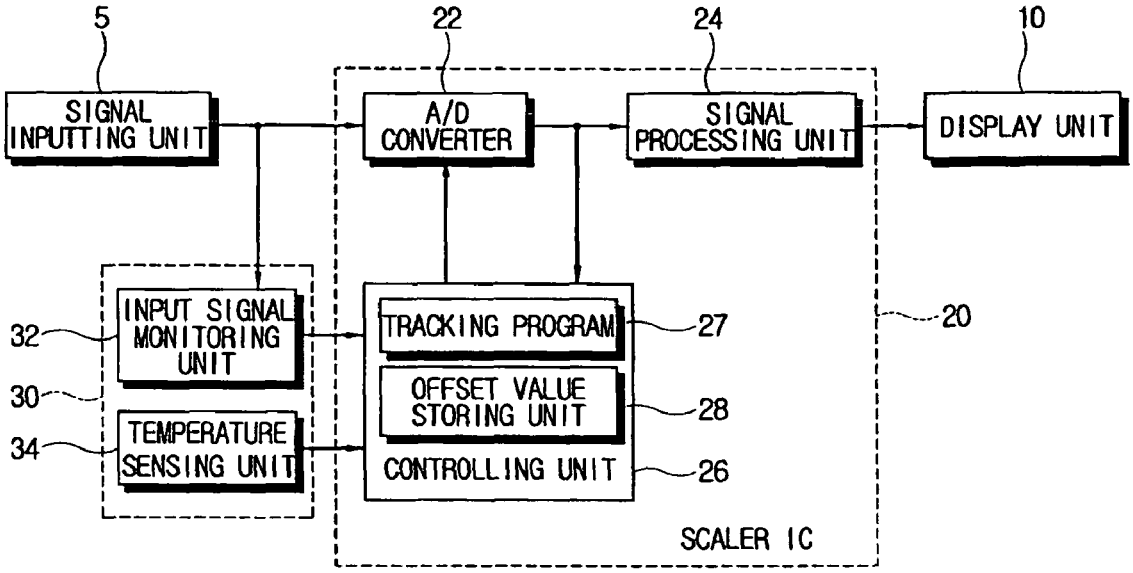
FIG. 1 is a control block diagram illustrating a displaying apparatus according to an embodiment of the present general inventive concept.

Reference will now be made in detail to the embodiments of the present general inventive concept, examples of which are illustrated in the accompanying drawings, wherein like reference numerals refer to like elements throughout. The embodiments are described below in order to explain the present general inventive concept by referring to the figures.

FIG. 1 is a control block diagram illustrating a displaying apparatus according to an embodiment of the present general inventive concept. Referring to FIG. 1, the displaying apparatus comprises a signal inputting unit 5 that receives an image signal input from outside the displaying apparatus, a displaying unit 10 that displays thereon an image picture based on the input image signal, a scaler integrated chip (IC) 20 that processes the image signal input through the signal inputting unit 5 so that the image signal is displayed on the displaying unit 10, and a monitoring unit 30 that senses a generation of an abnormal operating condition of an A/D converter 22. The scaler IC 20 includes the A/D converter 22, a signal processing unit 24, and a controlling unit 26.

The monitoring unit 30 functions to sense the generation of an abnormal operating condition of the A/D converter 22. The monitoring unit 30 comprises an input signal monitoring unit 32 to monitor an input state of an analog image signal input through the signal inputting unit 5 and a temperature sensing unit 34 to sense a temperature of the scaler IC 20.

The scaler IC 20 functions to process the image signal input through the signal inputting unit 5 so that the image signal is displayed on the displaying unit 10. As described above, the scaler IC 20 comprises the A/D converter 22 that converts the analog image signal into a digital image signal, the signal processing unit 24 that processes the digital image signal output from the A/D converter 22 to correspond to an appropriate format to display on the displaying unit 10. When the generation of an abnormal operating condition of the A/D converter 22 is sensed by the monitoring unit 30, the controlling unit 26 determines whether the digital image signal output from the A/D converter 22 corresponds to a desired reference digital image signal, and, if not, calibrates the output digital image signal so that the digital image signal output from the A/D converter 22 matches the desired reference digital image signal, which is described in more detail below.

The A/D converter 22 converts the analog image signal input through the signal inputting unit 5 into the output digital image signal according to a preset offset value thereof. The preset offset value of the A/D converter 22 is set through a color calibration by user manipulation during an initial operation of the displaying apparatus. The color calibration is an operation that determines an offset value of the A/D converter 22 that is appropriate to obtain the desired reference digital image signal at operating conditions including (1) a state of the analog image signal input to the A/D converter 22 and (2) a temperature of the scaler IC 20 according to a plurality of offset values stored in an offset value storing unit 28 of the controlling unit 26 (to be described below). The signal processing unit 24 processes the digital image signal output from the A/D converter 22 to correspond to the appropriate format to be displayed on the displaying unit 10. The signal processing unit 24 may include an image capturing unit (not shown) and a color converting unit (not shown).

The controlling unit 26 comprises the offset value storing unit 28 to store the plurality of offset values of the A/D converter corresponding to a plurality of reference digital image signals according to (1) the state of the analog image signal input to the A/D converter 22 and (2) the temperature of the scaler IC 20. The offset value storing unit 28 also stores information on the desired reference digital image signal to be output by the A/D converter 22 according to different operating conditions. In other words, the offset value storing unit 28 may store the plurality of reference digital image signals to correspond to the plurality of offset values of the A/D converter 22 at different operating conditions. The controlling unit 26 determines the appropriate offset value of the A/D converter 22 to obtain the desired reference digital image signal at current operation conditions through the color calibration, according to determinations made by the input signal monitoring unit 32 and by the temperature sensing unit 34. The desired reference digital image signal may be determined during an initial operation of the displaying apparatus. For example, the desired reference digital image signal may be specified by a user. The color calibration may then be performed to determine the appropriate offset value (i.e., the preset offset value) to obtain the desired reference digital image signal.

In addition, the controlling unit 26 stores therein a tracking program 27 to calibrate the digital image signal output from the A/D converter 22. When the monitoring unit 30 (i.e., the temperature sensing unit 34 and the input signal monitoring unit 32) senses a change in the temperature of the scaler IC 20 or a change in the analog image signal input, the controlling unit 26 compares the desired reference digital image signal information corresponding to the preset offset value (i.e., a current offset value) of the A/D converter 22 with the digital image signal output from the A/D converter 22, through the tracking program 27 according to the information stored by the offset value storing unit 28.

When the digital image signal output from the A/D converter 22 is different from the desired reference digital image signal, the controlling unit 26 calibrates the preset offset value of the A/D converter (i.e., changes the preset offset value to another one of the plurality of stored offset values) through the tracking program 27 so that the output digital image signal matches the desired reference digital image signal. The offset value storing unit 28 stores the plurality of offset values that produce a plurality of different reference digital image signals at different operating conditions. Thus, the desired reference digital image signal may have one or more corresponding offset values that correspond to one or more different operating conditions. Thus, when the controlling unit 26 calibrates the preset offset value of the A/D converter 22 using the tracking program 27, the controlling unit 26 changes the preset offset value to a selected one of the plurality of offset values according to a change in the operating conditions so that the desired reference digital image signal can be output by the A/D converter 22. The selected one of the plurality of stored offset values enables the A/D converter 22 to continue to output the desired reference digital image signal, regardless of changes in the operating conditions.

Accordingly, a color change in an image picture of the displaying unit 10 that results from a change in an operation environment of the A/D converter 22, such as an instable analog input signal or a change in the temperature of the scaler IC 20, may be prevented by converting the analog image signal into the digital image signal according to the preset offset value of the A/D converter 22.

The controlling unit 26 may perform the operation of calibrating the preset offset value of the A/D converter 22, through the tracking program 27, during a blanking period in which the image picture of the displaying unit 10 changes into a different image picture so that the digital image signal output from the A/D converter 22 matches the desired reference digital image signal.

Since the controlling unit 26 calibrates the preset offset value of the A/D converter 22 during the blanking period, a user does not visually perceive a color change in the image picture due to the offset value calibration that instantaneously occurs within the blanking period.

The controlling unit 26 may be included, in the scaler IC 20. Alternatively, the controlling unit 26 may be provided separately from the scaler IC 20. In addition, other arrangements of the controlling unit 26 may also be implemented according to the present general inventive concept.

Figure 2:
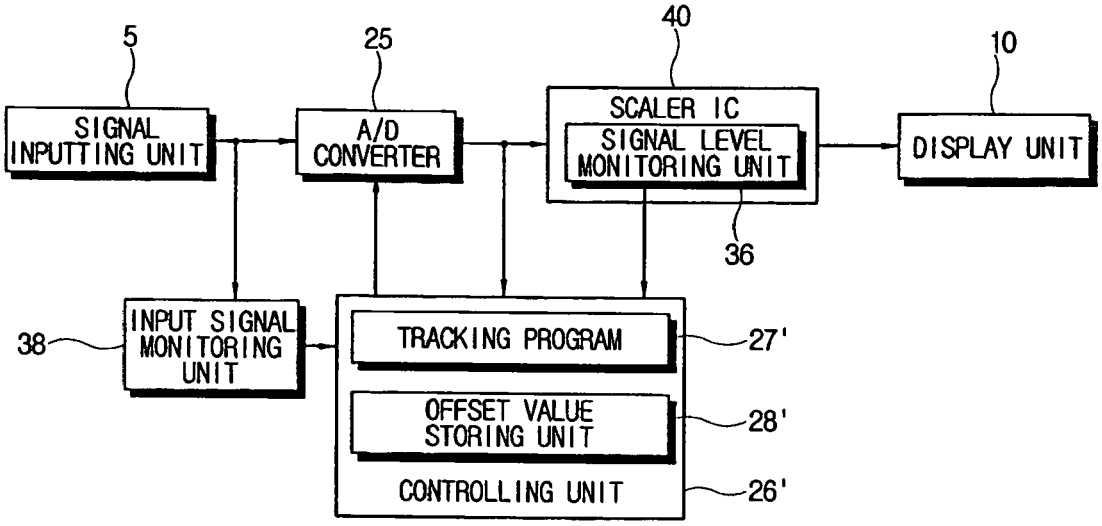
FIG. 2 is a control block diagram illustrating a displaying apparatus according to another embodiment of the present general inventive concept.

FIG. 2 is a control block diagram illustrating a displaying apparatus according to another embodiment of the present general inventive concept. Referring to FIG. 2, an A/D converter 25 is provided separately from a scaler IC 40. The displaying apparatus comprises a signal inputting unit 5 that receives an image signal input from outside the displaying apparatus, a displaying unit 10 that displays the image signal as an image picture, the A/D converter 25 that converts an analog image signal into a digital image signal, a scaler IC 40 that processes the digital image signal output from the A/D converter 25 to correspond to an appropriate format to be displayed on the displaying unit 10, monitoring units 36 and 38 that sense a generation of any abnormal operating condition of the A/D converter 25, and a controlling unit 26' that determines whether the digital image signal output from the A/D converter 25 corresponds to a desired reference digital image signal and calibrates the output digital image signal so that the digital image signal output from the A/D converter 25 matches the desired reference digital image signal when a generation of an abnormal operating condition of the A/D converter 25 is sensed by the monitoring units 36 and 38.

The monitoring units 36 and 38 function to sense the generation of an abnormal operating condition of the A/D converter 25. The monitoring units 36 and 38 comprise an input signal monitoring unit 38 that monitors an input state of the analog image signal input through the signal inputting unit 5, and a signal level monitoring unit 36 that monitors a state of a digital image signal output from the A/D converter 25.

The A/D converter 25 converts the analog image signal input through the signal inputting unit 5 into the output digital image signal according to a preset offset value of the A/D converter 25 and outputs the digital image signal to the scaler IC 40. The preset offset value of the A/D converter 25 is set through a color calibration by user manipulation during an initial operation of the displaying apparatus. The color calibration refers to an operation that determines an offset value of the A/D converter 25 appropriate to obtain the desired reference digital image signal at operating conditions including both (1) a temperature of an image signal processing unit (not shown) comprising the A/D converter 25, a scaler IC 40, etc., and (2) a state of an analog image signal input to the A/D converter 25 according to a plurality of offset values stored in an offset value storing unit 28' of the controlling unit 26' to be described below.

The scaler IC 40 functions to process the digital image signal output from the A/D converter 25 in the appropriate format to be displayed on the displaying unit 10. The scaler IC 40 comprises the signal level monitoring unit 36 to monitor any change in the state of the digital image signal output from the A/D converter 25. When a change in the state of the digital image signal output from the A/D converter 25 is detected by the signal level monitoring unit 36, the scaler IC 40 outputs a signal to inform the controlling unit 26' of the generation of an abnormal operating condition.

The controlling unit 26' comprises the offset value storing unit 28' to store the plurality offset values of the A/D converter 25 which correspond to a plurality of reference digital image signals according to (1) a state of an analog image signal input to the A/D converter 22 and (2) a temperature of an image signal processing unit (not shown) comprising the A/D converter 25, the scaler IC 40, etc. The offset value storing unit 28' also stores information on the desired reference digital image signal to be output by the A/D converter 25 according to different operating conditions. In other words, the offset value storing unit 28' may store the plurality of reference digital image signals to correspond to the plurality of offset values of the A/D converter 25 at different operating conditions. The controlling unit 26' determines the appropriate offset value as the preset offset value of the A/D converter 25 to obtain the desired reference digital image signal through the color calibration. The desired reference digital image signal may be determined during an initial operation of the displaying apparatus. For example, the desired reference digital image signal may be specified by a user. The color calibration may then be performed to determine the appropriate offset value (i.e., the preset offset value) to obtain the desired reference digital image signal.

In addition, the controlling unit 26' stores therein a tracking program 27' to calibrate the digital image signal output from the A/D converter 25. When the signal level monitoring unit 36 and/or the input signal monitoring unit 38 detect a change in the state of the digital image signal as a result of a change in the temperature of the A/D converter 25 or a change in the analog image signal input to the A/D converter 25, the controlling unit 26' compares the information of the desired reference digital image signal corresponding to the preset offset value (i.e., the current offset value) of the A/D converter 25 with the digital image signal output from the A/D converter 25 through the tracking program 27' according to the information stored by the offset value storing unit 28'.

When the digital image signal output from the A/D converter 25 is different from the information of the desired reference digital image signal, the controlling unit 26' calibrates the preset offset value (i.e., changes the preset offset value to another one of the stored plurality of offset values) of the A/D converter 25 through the tracking program 27' so that the output digital image signal matches the desired reference digital image signal. The offset value storing unit 28' stores the plurality of offset values that produce a plurality of different reference digital image signals at different operating conditions. Thus, the desired reference digital image signal may have one or more corresponding offset values that correspond to one or more different operating conditions. Thus, when the controlling unit 26' calibrates the preset offset value of the A/D converter 25 using the tracking program 27', the controlling unit 26' changes the preset offset value to a selected one of the plurality of offset values according to a change in the operating conditions so that the desired reference digital image signal can be output by the A/D converter 25. The selected one of the plurality of stored offset values enables the A/D converter 25 to continue to output the desired reference digital image signal, regardless of changes in the operating conditions.

Accordingly, a color change in the image picture of the displaying unit 10 that results from a change in the operation environment of the A/D converter 25, such as an instable state of the analog input signal or a change in the temperature of the image signal processing unit (not shown), may be prevented when the A/D converter 25 converts the analog image signal into the digital image signal.

The controlling unit 26' may perform the operation of calibrating the preset offset value of the A/D converter 25 during the blanking period in which an image picture of the displaying unit 10 changes into a different image picture so that the digital image signal output from the A/D converter 25 matches the desired reference digital image signal.

Since the controlling unit 26' calibrates the offset value of the A/D converter 26 during the blanking period, a user is prevented from visually perceiving any color change of the image picture due the offset value calibration that instantaneously occurs within the blanking period.

The controlling unit 26' may be provided separately from a scaler IC 40. Alternatively, the controlling unit 26' may be included in the scaler IC 40. In addition, other arrangements of the controlling unit 26' may also be implemented according to the present general inventive concept.

Figure 3:
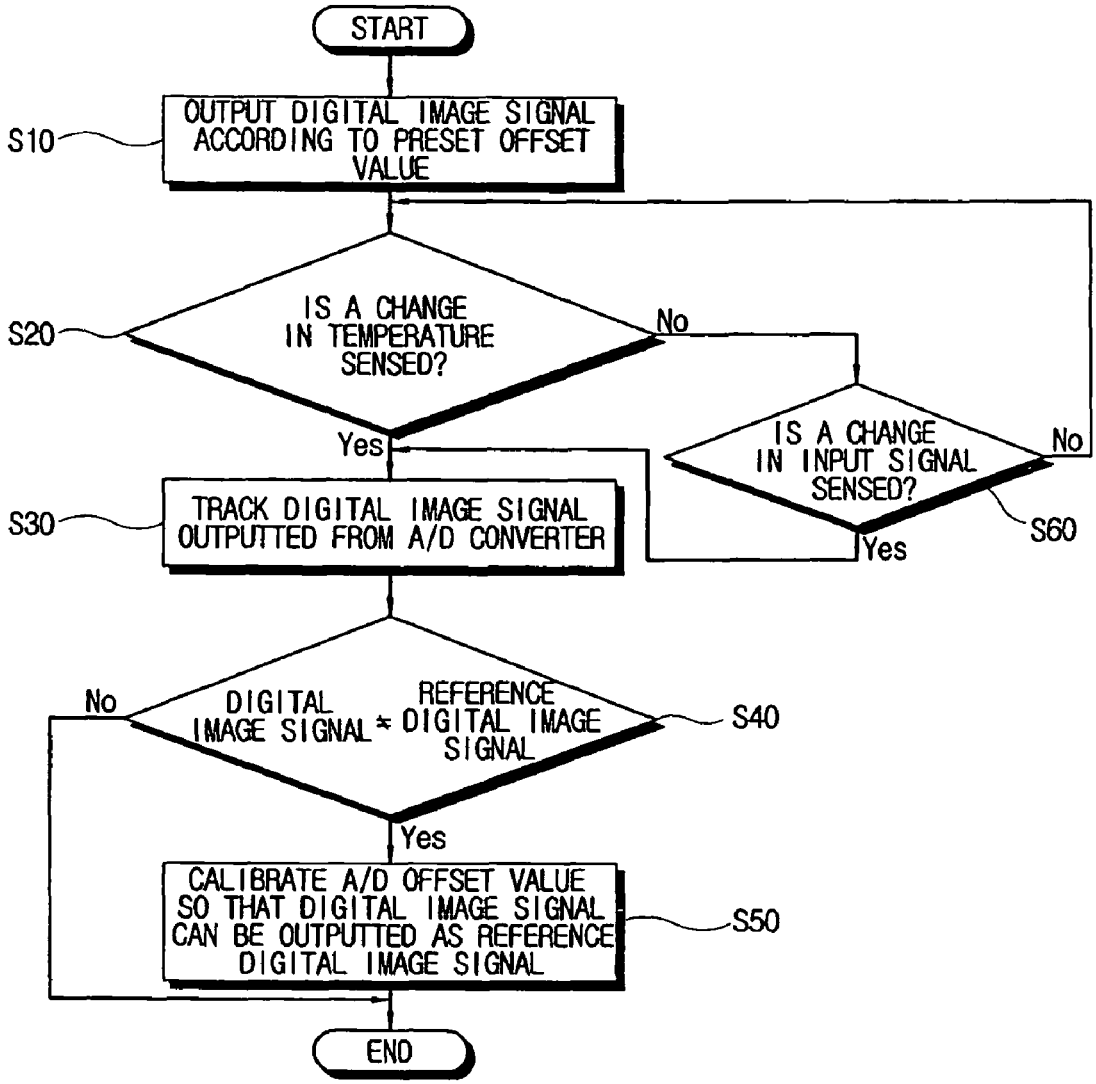
FIG. 3 is a flow chart illustrating a control method of the displaying apparatus of FIG. 1 according to an embodiment of the present general inventive concept.

FIG. 3 illustrates a method of controlling the displaying apparatus of FIG. 1 according to an embodiment of the present general inventive concept.

Referring to FIGS. 1 and 3, the A/D converter 22 converts an input analog image signal into a digital image signal according to a preset offset value thereof that is preset through a color calibration at operation S10. The controlling unit 26 determines whether a temperature of the scaler IC 20 has changed according to a determination made by the temperature sensing unit 34 at operation S20. When a change in the temperature of the scaler IC 20 is sensed, the controlling unit 26 tracks the digital image signal output from the A/D converter 22 through the tracking program 27 at operation S30. The controlling unit 26 compares the tracked digital image signal with a desired reference digital image signal according to the preset offset value and determines whether they are identical with respect to each other at operation S40. When the output digital image signal is different from the desired reference digital image signal, the controlling unit 26 calibrates the preset offset value of the A/D converter 22 through the tracking program 27 so that the digital image signal output from the A/D converter matches the desired reference digital image signal at operation S50. Operation S50 may be performed during the blanking period in which the image picture of the displaying unit 10 changes into a different image picture.

At operation S20, when the temperature of the scaler IC 20 has not changed, the controlling unit 26 determines whether a signal state of the analog image signal input to the A/D converter 22 has changed according to a determination made by the input signal monitoring unit 32 at operation S60. When the signal state of the analog image signal has changed, the controlling unit 26 returns back to operation S30 and performs respective operations following operation S30.

Accordingly, a color change in the image picture of the displaying unit 10 that results from a change in the operation environment of the A/D converter 22 such as an instable state of the input analog signal or a change in the temperature of the scaler IC 20 may be prevented.

Figure 4:
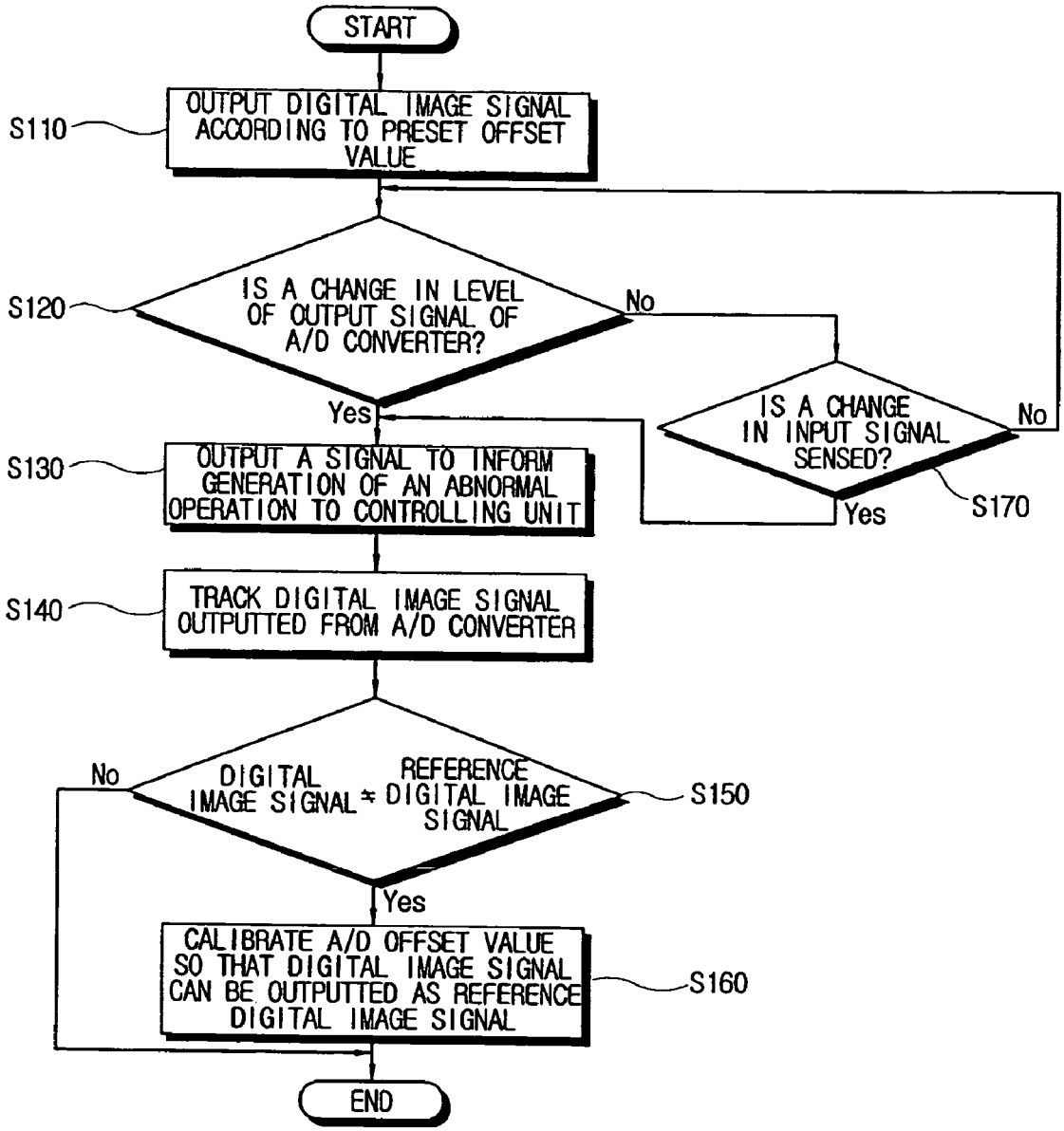
FIG. 4 is a flow chart illustrating a control method of the displaying apparatus of FIG. 2 according to another embodiment of the present general inventive concept.

FIG. 4 illustrates a method of controlling the displaying apparatus of FIG. 2 according to another embodiment of the present general inventive concept.

Referring to FIGS. 2 and 4, the A/D converter 25 converts an input analog image signal into a digital image signal according to a preset offset value that is preset through a color calibration at operation S110. The signal level monitoring unit 36 monitors any state change in the digital image signal output from the A/D converter 25 at operation S120. When a state change in the digital image signal output from the A/D converter 25 is sensed, the signal level monitoring part 36 outputs a signal to inform the controlling unit 26' of a generation of an abnormal state at operation S130. The controlling unit 26' receives the signal and tracks the digital image signal output from the A/D converter 25 through the tracking program 27' at operation S140.

The controlling unit 26' compares the tracked digital image signal with a desired reference digital image signal according to the preset offset value and determines whether they are identical with respect to each other at operation S150. When the output digital image signal is different from the desired reference digital image signal, the controlling unit 26' calibrates the preset offset value of the A/D converter 25 through the tracking program 27' so that the digital image signal output from the A/D converter matches the desired reference digital image signal at operation S160. Operation S160 may be performed during the blanking period in which the image picture of the displaying unit 10 changes into a different image picture.

At operation S120, when no state change in the digital image signal output from the A/D converter 25 has occurred, the controlling unit 26' determines whether a signal state of the analog image signal input to the A/D converter 25 has changed, based on a determination made by the input signal monitoring unit 38 at operation S170. When the signal state of the analog image signal has changed, the controlling unit 26' returns back to operation S140 and performs respective operations following operation S140.

Accordingly, a color change in the image picture of the displaying unit 10 that results from a change in the operation environment of the A/D converter 25, such as an instable state of the input analog signal or a change in the temperature of the image signal processing unit (not shown), may be prevented.

In accordance with the above described configurations and/or operations, a displaying apparatus, can automatically calibrate offset values of an A/D converter when a digital image signal having desired RGB data (i.e., color data) according to preset offset values of the A/D converter cannot be output due to a change in temperature condition or a change in signal state of an input analog image signal that has occurred since an initial color calibration.

In this respect, the A/D converter of the displaying apparatus according to various embodiments of the present general inventive concept may output a digital image signal having the desired RGB data corresponding to an offset value thereof set through the initial color calibration, regardless of changes in temperature conditions or changes in a state of an input analog image signal, thereby maintaining color regularity in an image picture displayed on a displaying unit.

As described above, according to various embodiments of the present general inventive concept, there is provided a displaying apparatus capable of maintaining color regularity in image pictures that are displayed, regardless of the changes in temperature conditions of the image signal processing unit or the changes in a state of an input analog image signal Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A display apparatus, comprising:

A signal input unit to receive an analog image signal;

An image processing unit to process the received analog image signal and to output a digital image signal having first color data;

A monitoring unit to receive the analog image signal from the signal input unit at a point upstream from the image processing unit, to sense a change in an input level of the received analog image signal, and to sense a change in temperature of the image processing unit that cause the image processing unit to output first color data different than predetermined color data of the digital image signal; and a controlling unit to calibrate the image processing unit according to the change in the input level of the analog image signal and the change in temperature of the image processing unit, respectively, to cause the image processing unit to output the first color data that is the same as the predetermined color data, wherein the monitoring unit senses a change in the input level of the received analog image signal independently of a change in temperature of the image processing unit.

2. The apparatus as claimed in claim 1, wherein the image processing unit comprises an A/D converter to convert the analog image signal from an analog format to a digital format according to a preset offset value.

3. The apparatus as claimed in claim 2, wherein the predetermined color data is determined by the preset offset value of the A/D converter that is set during an initial calibration operation of the image processing unit.

4. The apparatus as claimed in claim 2, wherein the monitoring unit comprises:

a temperature sensing unit to sense a temperature of the image processing unit, and an input signal monitoring unit to monitor the received analog image signal and to detect any changes in a signal level thereof.

5. The apparatus as claimed in claim 4, wherein the controlling unit comprises an offset value storing unit to store a plurality of offset values for the A/D converter, and each respective offset value of the plurality of offset values is appropriate to cause the imaging processing unit to output the first color data corresponding to the predetermined color data at a respective operating condition including at least one of a respective temperature of the image processing unit and a respective signal level of the analog image signal.

6. The apparatus as claimed in claim 5, wherein the controlling unit calibrates the image processing unit according to the one or more changes in the operating conditions by accessing the offset value storing unit to determine a selected offset value for the A/D converter according to the temperature of the image processing unit and the signal level of the received analog image signal.

7. The apparatus as claimed in claim 5, wherein:

the predetermined color data comprises a desired reference digital image signal; and the plurality of stored offset values correspond to a plurality of reference digital image signals that are respectively obtainable according to one or more respective operating conditions.

8. The apparatus as claimed in claim 2, wherein the predetermined color data comprises a reference digital image signal.

9. The apparatus as claimed in claim 8, wherein the controlling unit comprises a tracking program to track the digital image signal by comparing the digital image signal to the reference digital image signal to determine whether the digital image signal includes the predetermined color data.

10. The apparatus as claimed in claim 2, wherein the monitoring unit comprises:

an input signal monitoring unit to monitor the received analog image signal to detect any changes in a signal level thereof, and a signal level monitoring unit to monitor the digital image signal output from the A/D converter to detect any changes in a signal level thereof in order to detect abnormal operation of the image processing unit.

11. The apparatus as claimed in claim 10, wherein:

the controlling unit comprises an offset value storing unit to store a plurality of offset values for the A/D converter, and each of the plurality of offset values is appropriate to cause the image processing unit to output the first color data that corresponds to the predetermined color data at a respective signal level of the analog image signal.

12. The apparatus as claimed in claim 11, wherein the controlling unit calibrates the image processing unit according to the one or more changes in the operating conditions by accessing the offset value storing unit to determine a selected offset value for the A/D converter according to the signal level of the received analog image signal and according to whether abnormal operation of the image processing unit is detected.

13. The apparatus as claimed in claim 1, wherein the controlling unit calibrates the image processing unit during a blanking period of an image being displayed according to the one or more changes in the operating conditions using a tracking program to track the digital image signal with respect to a reference digital image signal having the predetermined color data.

14. A method of maintaining color regularity in a display apparatus, the method comprising:

processing an analog image signal and outputting a digital image signal having first color data using a processor;

monitoring the analog image signal in a state before the analog image signal is processed to generate the digital image signal;

monitoring a change in temperature of the processor; and calibrating the processor according to a monitored change in the analog image signal and the temperature of the processor, respectively, to cause the first color data of the output digital image signal to correspond to the predetermined color data, wherein a change in an input level of the analog image signal is monitored independently of a change in temperature of the processor.

15. The method as claimed in claim 14, wherein the processing of the analog image signal comprises:

converting the analog image signal from an analog format to a digital format according to a preset offset value of an A/D converter.

16. The method as claimed in claim 15, wherein the predetermined color data is determined by the preset offset value of the A/D converter that is set during an initial calibration operation of the processor.

17. The method as claimed in claim 14, further comprising:

storing a plurality of offset values for the A/D converter in an offset value storing unit, wherein each of the plurality of offset values is appropriate to cause the first color data of the output digital image signal to correspond to the predetermined color data at a respective operating condition including at least one of a respective temperature of the processor and a respective signal level of the analog image signal.

18. The method as claimed in claim 17, wherein the calibrating of the processor according to the one or more changes in the operating conditions comprises accessing the offset value storing unit to determine a selected offset value for the A/D converter according to the temperature of the processor and the signal level of the received analog image signal.

19. The method as claimed in claim 17, wherein:

the predetermined color data comprises a desired reference digital image signal, and the plurality of stored offset values correspond to a plurality of reference digital image signals that correspond to one or more respective operating conditions.

20. The method as claimed in claim 15, wherein the predetermined color data comprises a reference digital image signal.

21. The method as claimed in claim 20, further comprising:

tracking the digital image signal by comparing the digital image signal to the reference digital image signal to determine whether the digital image signal includes the predetermined color data.

22. The method as claimed in claim 20, wherein the reference digital image signal is set according to a user preference during an initial calibration.

23. The method as claimed in claim 15, wherein the monitoring of the temperature of the processor comprises:

monitoring the digital image signal output from the A/D converter to detect any changes in a signal level thereof in order to detect abnormal operation of the processor.

24. The method as claimed in claim 23, further comprising:

storing a plurality of offset values for the A/D converter in an offset value storing unit, wherein each of the plurality of offset values is appropriate to cause the first color data of the output digital image signal to correspond to the predetermined color data at a respective signal level of the analog image signal.

25. The method as claimed in claim 24, wherein the calibrating of the processor according to the monitored change in the analog image signal and the temperature of the processor, respectively, comprises accessing the offset value storing unit to determine a selected offset value for the A/D converter according to the signal level of the received analog image signal and according to whether abnormal operation of the processor is detected.

26. The method as claimed in claim 23, wherein the calibrating of the processor according to the monitored change in the analog image signal and the temperature of the processor, respectively, comprises:

tracking the digital image signal only during a blanking period of an image being displayed with respect to a reference digital image signal having the predetermined color data.

27. A display apparatus, comprising:

a signal input unit to receive an analog image signal;

an image processing unit to process the received analog image signal and to output a digital image signal having predetermined image data;

a monitoring unit to monitor the received analog image signal upstream from the image processing unit, to monitor a temperature of the image processing unit, and to sense one or more changes in the received analog image signal and the temperature of the image processing unit that cause the predetermined image data of the digital image signal to change; and a controlling unit to calibrate the image processing unit according to the one or more changes in the received analog image signal and the temperature of the image processing unit to cause the output digital image signal to maintain the predetermined image data, wherein the monitoring unit senses a change in the input level of the received analog image signal independently of a change in temperature of the image processing unit.

* * * * *